US010895360B2

(12) United States Patent
Suetsugu

(10) Patent No.: US 10,895,360 B2
(45) Date of Patent: Jan. 19, 2021

(54) VEHICLE LAMP

(71) Applicant: Koito Manufacturing Co., Ltd., Tokyo (JP)

(72) Inventor: Makiko Suetsugu, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/152,534

(22) Filed: Oct. 5, 2018

(65) Prior Publication Data

US 2019/0145596 A1 May 16, 2019

(30) Foreign Application Priority Data

Oct. 13, 2017 (JP) ..... 2017-199431

(51) Int. Cl.

| | |
|---|---|
| ***F21S 41/20*** | (2018.01) |
| ***F21S 41/25*** | (2018.01) |
| ***F21S 41/143*** | (2018.01) |
| *F21W 102/13* | (2018.01) |
| *F21Y 115/10* | (2016.01) |

(52) U.S. Cl.

CPC ..... *F21S 41/285* (2018.01); *F21S 41/143* (2018.01); *F21S 41/25* (2018.01); *F21W 2102/13* (2018.01); *F21Y 2115/10* (2016.08)

(58) Field of Classification Search

CPC ..... F21S 41/25; F21V 5/045

See application file for complete search history.

(56) References Cited

U.S. PATENT DOCUMENTS

2008/0239740 A1* 10/2008 Nakada ..... F21S 41/147 362/507

2017/0276309 A1* 9/2017 Nakazawa ..... F21S 41/143

FOREIGN PATENT DOCUMENTS

JP 2016-058166 A 4/2016

* cited by examiner

*Primary Examiner* — Joseph L Williams

*Assistant Examiner* — Jacob R Stern

(74) *Attorney, Agent, or Firm* — Abelman, Frayne & Schwab

(57) ABSTRACT

A vehicle lamp includes a projection lens and a plurality of light emitting elements arranged in parallel in a required direction behind the projection lens, and is configured to irradiate light emitted from each of the light emitting elements toward a front side through the projection lens. A plurality of diffusing lens elements that diffuse the light emitted from each of the light emitting elements in the required direction are provided on a front surface and/or a rear surface of the projection lens in a stripe shape to extend in a direction orthogonal to the required direction when viewed from the front side of the lamp.

11 Claims, 12 Drawing Sheets

VEHICLE LAMP

CROSS-REFERENCE TO RELATED APPLICATIONS

This application is based on and claims priority from Japanese Patent Application No. 2017-199431, filed on Oct. 13, 2017 with the Japan Patent Office, the disclosure of which is incorporated herein in its entirety by reference.

TECHNICAL FIELD

The present disclosure relates to a projector type vehicle lamp.

BACKGROUND

In the related art, there has been known a projector type vehicle lamp configured to irradiate light from a light source arranged behind a projection lens toward the front side through the projection lens.

Japanese Patent Laid-Open Publication No. 2016-058166 discloses a vehicle lamp that includes, as a light source, a plurality of light emitting elements arranged in parallel in a left-right direction.

In addition, the vehicle lamp disclosed in Japanese Patent Laid-Open Publication No. 2016-058166 is configured to form a horizontally elongated light distribution pattern as an aggregate of light source images of the respective light emitting elements (i.e., images of light emitting elements reversely projected by the projection lens) when simultaneously turning on the plurality of light emitting elements.

At this time, in the vehicle lamp disclosed in Japanese Patent Laid-Open Publication No. 2016-058166, the plurality of light emitting elements are arranged at a position displaced rearward from a real focal point of the projection lens. Thus, the light source image of each light emitting element formed by light emitted forward from the projection lens is enlarged to partially overlap with each other, so that the horizontally elongated light distribution pattern is formed as a continuous light distribution pattern.

SUMMARY

By adopting the configuration disclosed in Japanese Patent Laid-Open Publication No. 2016-058166, it is possible to form a horizontally elongated light distribution pattern as a continuous light distribution pattern. However, since the light source images of the respective light emitting elements are enlarged in all directions, it is not easy to ensure the brightness of the horizontally elongated light distribution pattern.

The present disclosure has been made in view of the above circumstances, and an object of the present disclosure is to provide a vehicle lamp configured to irradiate light emitted from a plurality of light emitting elements toward the front through a projection lens, which is capable of forming a light distribution pattern formed by the irradiated light as a continuous bright light distribution pattern.

The present disclosure facilitates the achievement of the above-described object by considering the configuration of the projection lens.

That is, a vehicle lamp according to the present disclosure includes a projection lens, and a plurality of light emitting elements arranged in parallel in a required direction behind the projection lens. The vehicle lamp is configured to irradiate light emitted from each of the each light emitting elements toward a front side 3 through the projection lens. A plurality of diffusing lens elements that diffuse the light emitted from each of the light emitting elements in the required direction are provided on a front surface and/or a rear surface of the projection lens in a stripe shape to extend in a direction orthogonal to the required direction when viewed from a front side of the lamp.

A specific direction of the "required direction" is not particularly limited, and, for example, a vertical direction or a left-right direction may be adopted.

A type of the "light emitting element" is not particularly limited, and, for example, a light emitting diode may be adopted.

As long as the "plurality of diffusing lens elements" are configured to diffuse the light emitted from each of the light emitting elements in the required direction, a specific value of a light diffusing angle by each diffusing lens element is not particularly limited.

The vehicle lamp according to the present disclosure has a configuration in which a plurality of light emitting elements are arranged in parallel in a required direction behind a projection lens, and light emitted from each of the light emitting elements is irradiated toward the front through the projection lens. Thus, when simultaneously turning on the plurality of the light emitting elements, it is possible to form a light distribution pattern extending in the required direction as an aggregate of light source images of the respective light emitting elements.

In addition, on a front surface and/or a rear surface of the projection lens, a plurality of diffusing lens elements that diffuse the light emitted from each of the light emitting elements in the required direction are provided in a stripe shape to extend in a direction orthogonal to the required direction when viewed from the front of the lamp. Thus, the light source images of the respective light emitting elements may be formed partially overlapping with each other.

At this time, the light source images of the respective light emitting elements are enlarged in the required direction by the plurality of diffusing lens elements, but are not enlarged in all directions. Thus, it is possible to secure brightness of the horizontally elongated light distribution pattern.

As described above, according to the present disclosure, in a vehicle lamp configured to irradiate light emitted from a plurality of light emitting elements toward the front through a projection lens, a light distribution pattern formed by the irradiated light may be formed as a continuous bright light distribution pattern.

In the above-described configuration, as a configuration of each diffusing lens element, when a light diffusing angle in the required direction is set to a larger value in a center region of the projection lens than in a peripheral region located on both sides of the required direction of the center region, the following operational effects may be obtained.

That is, when it is assumed that the plurality of diffusing lens elements are not provided on the front surface and/or the rear surface of the projection lens, a light source images of the light emitting element formed as a reversely projected image by the projection lens has different brightness and size depending on the position of the light emitting element. Specifically, the light source image of the light emitting element positioned in the vicinity of an optical axis of the projection lens is small and bright, while the light source image of the light emitting element at a position away from the optical axis of the projection lens is large and dark.

Therefore, the horizontally elongated light distribution pattern becomes brighter in a portion positioned in a front direction of the lamp, but a dark portion formed between the light source images becomes noticeable. Meanwhile, in the portion apart from the left-right direction in the front direction of the lamp, the dark portion between the light source images is not noticeable, but the light source image itself becomes dark.

In this regard, as a configuration of each diffusing lens element, by setting a light diffusing angle in the required direction to a larger value in a center region of the projection lens than in a peripheral region, it is possible to effectively suppress occurrence of light non-uniformity in the light source images of the respective light emitting elements enlarged in the required direction. Therefore, the light distribution pattern as an aggregate of the plurality of light source images may be formed as a light distribution pattern with less light non-uniformity.

Moreover, in the peripheral region where the light diffusing angle of each diffusing lens element is set to a small value, the unevenness of the surface may be reduced, so that the projection lens may be easily formed.

In the above-described configuration, in a plurality of diffusing lens elements, when a cross-sectional shape along the required direction is set to be corrugated, it is possible to form the plurality of light source images so as to be smoothly continued in the required direction. Therefore, the light non-uniformity of the light distribution pattern may be effectively suppressed.

In the above-described configuration, when having a configuration in which the plurality of light emitting elements are arranged at a position displaced in a front-rear direction from the rear side focal point of the projection lens, it is possible to enlarge the light source image of each light emitting element so as to partially overlap with each other. Therefore, the light non-uniformity of the light distribution pattern may be more effectively suppressed.

In the above-described configuration, in a case where the required direction is set to a left-right direction, when the plurality of diffusing lens elements are provided in a vertical stripe shape on the front surface of the projection lens, it is possible to control the diffusing when emitting the light emitted from each light emitting element that reaches the projection lens from the projection lens, and thus the accuracy of the light diffusing angle in the left-right direction may be enhanced. Therefore, it is possible to more easily form the horizontally elongated light distribution pattern as a light distribution pattern with less light non-uniformity.

After adopting the above-described configuration, when a plurality of second diffusing lens elements which diffuse the light emitted from each light emitting element in the vertical direction is provided on the rear surface of the projection lens in a horizontal stripe shape, it is possible to increase a vertical width of the horizontally elongated light distribution pattern.

At this time, when a light diffusing angle in the vertical direction is set to a larger value in a center region of the projection lens than in a peripheral region located on both upper and lower sides of the center region, the following operational effects may be obtained.

That is, as a configuration of a vehicle lamp, even when adopting a configuration in which a plurality of light emitting elements arranged in parallel in a left-right direction are arranged in a plurality of tiers in the vertical direction, it is possible to effectively suppress occurrence of light non-uniformity on the light source image of each light emitting element enlarged in the vertical direction. Therefore, even in the case where a light distribution pattern having a two-dimensional area formed by expanding the horizontally elongated light distribution pattern in the vertical direction is formed, the light non-uniformity may be effectively suppressed.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Hereinafter, an embodiment of the present disclosure will be described with reference to drawings.

Figure 1:
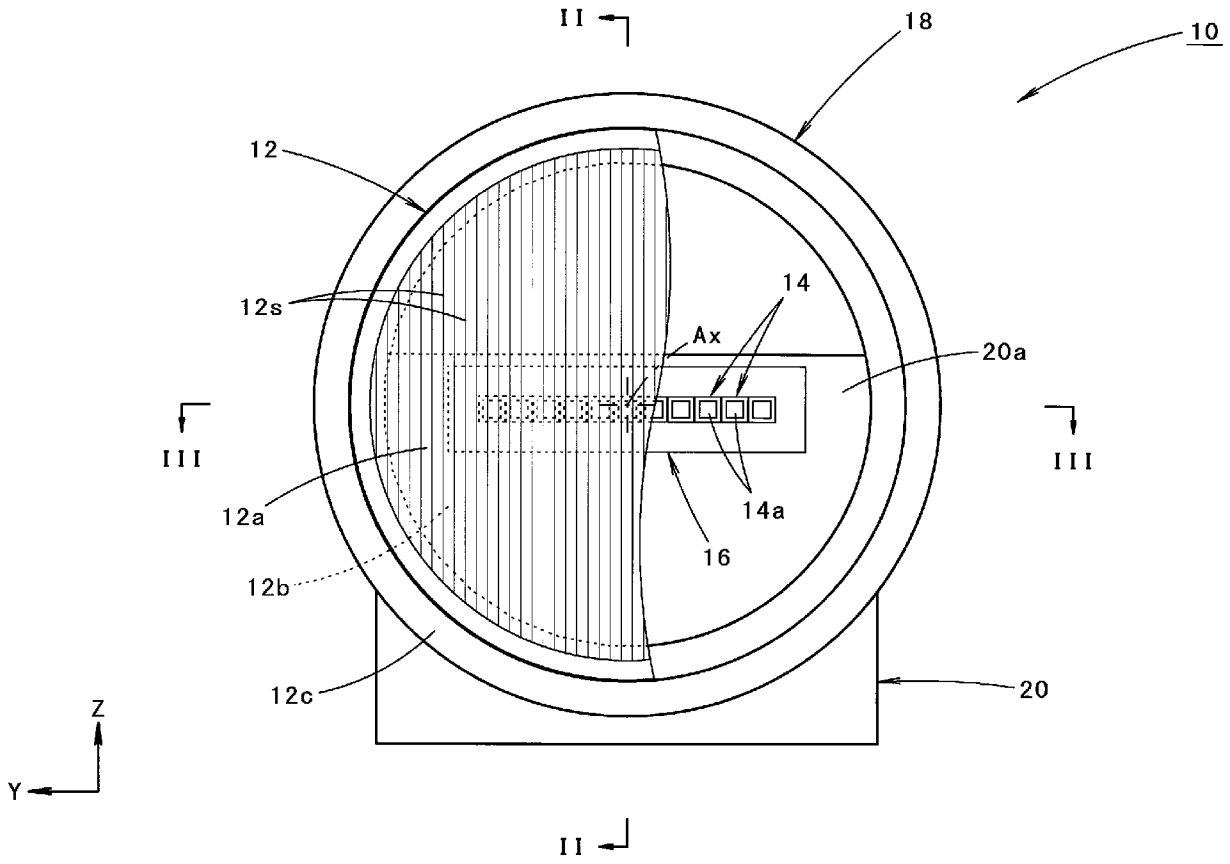
FIG. 1 is a front view illustrating a vehicle lamp according to an embodiment of the present disclosure.
Figure 2:
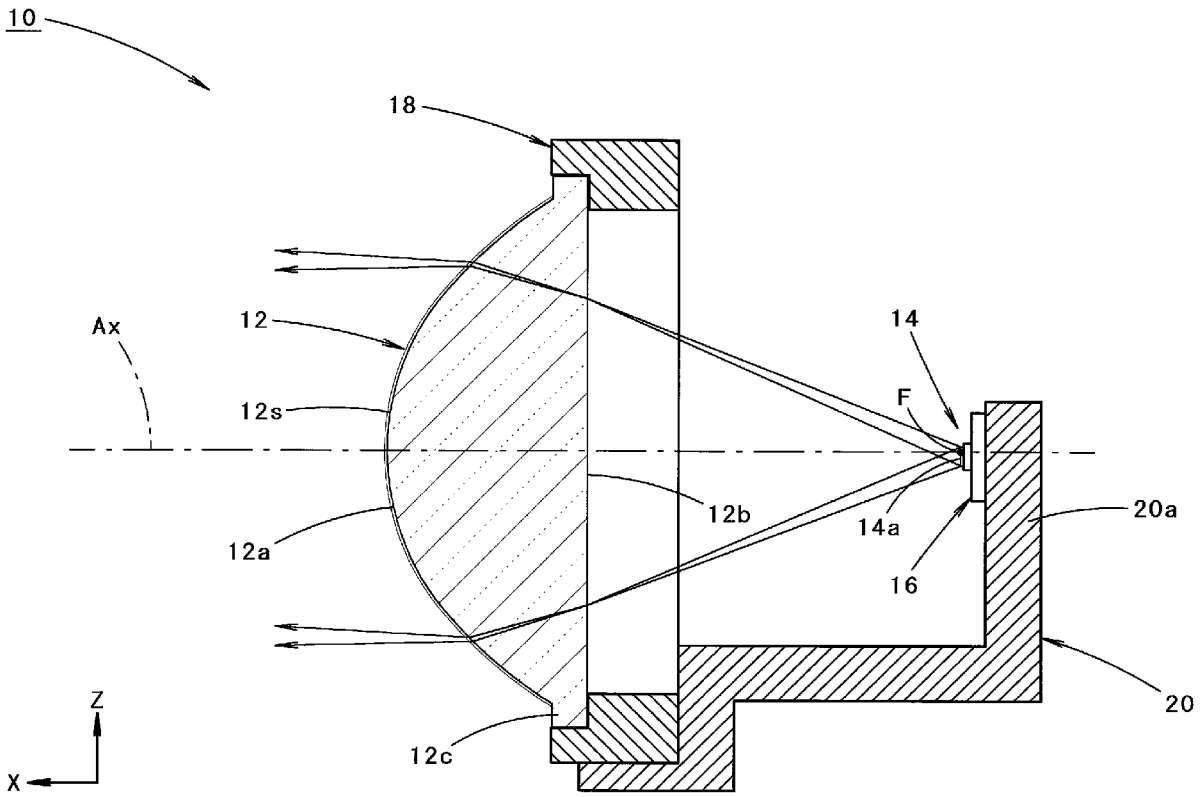
FIG. 2 is a sectional view taken along line II-II of FIG. 1.
Figure 3:
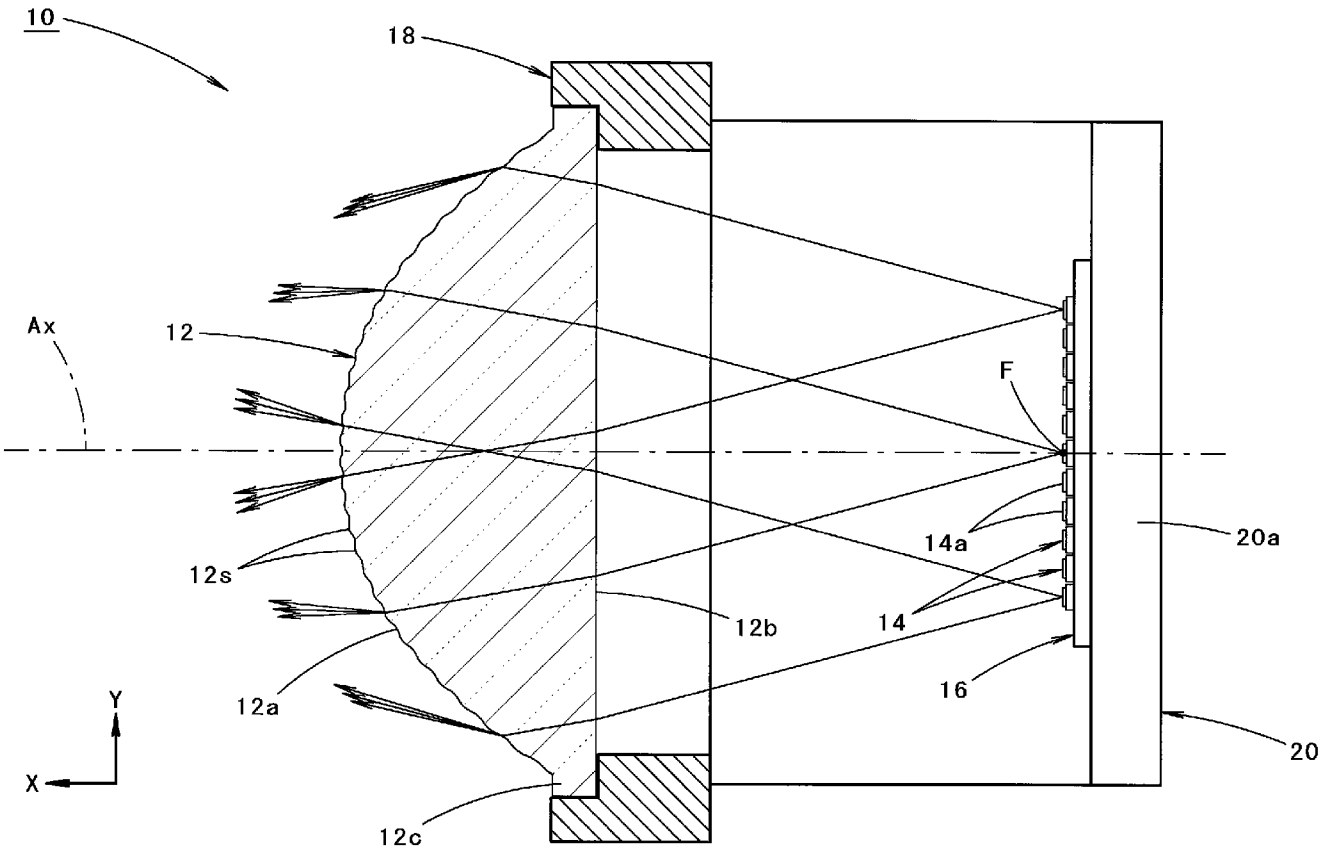
FIG. 3 is a sectional view taken along line III-III of FIG. 1.

FIG. 1 is a front view illustrating a vehicle lamp 10 according to an embodiment of the present disclosure. FIG. 2 is a cross-sectional view taken along line II-II of FIG. 1, and FIG. 3 is a cross-sectional view taken along line III-III of FIG. 1.

In these drawings, a direction indicated by X is a "front side" for a lamp (also "front side" for a vehicle), a direction indicated by Y is a "right direction" orthogonal to the "front side" (it is also a "right direction" for a vehicle, but it is a "left direction" in the front view of the lamp), and a direction indicated by Z is "upward". This is also applied to other drawings.

As illustrated in these drawings, the vehicle lamp 10 according to the present embodiment is a projector type lamp unit which is configured to additionally form a high beam additional light distribution pattern with respect to a low beam light distribution pattern.

The vehicle lamp 10 is provided with a projection lens 12 having an optical axis Ax extending in a front-rear direction of the vehicle, and eleven light emitting elements 14 arranged in parallel in a left-right direction behind the projection lens 12, and is configured to irradiate light emitted from each light emitting element 14 to the front through the projection lens 12.

The projection lens 12 is a plano-convex aspherical lens in which the front surface is a convex surface and the rear surface is a flat surface, and is configured to project a light source image formed on a rear side focal point plane which is a focal point plane including a rear side focal point F thereof onto a virtual vertical screen in the front of the lamp, as a reversed image. The projection lens 12 has a circular outer shape when viewed from the front side of the lamp, and is supported by a lens holder 18 at an outer peripheral flange portion 12*c* thereof.

The eleven light emitting elements 14 are white light emitting diodes having the same configuration, and are arranged equidistantly around a position of a vertical plane including the optical axis Ax on the rear side focal point plane of the projection lens 12.

Each light emitting element 14 has a rectangular (specifically, square) light emitting surface 14*a*, and is supported by a common substrate 16 with the light emitting surface 14*a* facing the front direction of the lamp. At this time, a constant gap is formed between the light emitting surfaces 14*a* of each of the light emitting elements 14.

Each light emitting element 14 is arranged in a state where the center of the light emitting surface 14*a* is positioned slightly below the optical axis Ax, and an upper end edge thereof is positioned slightly above the optical axis Ax.

The eleven light emitting elements 14 are configured to be turned on individually. That is, the eleven light emitting elements 14 are controlled to be turned on/off by a electronic controller (not illustrated) according to a driving situation of the own vehicle. At this time, the driving situation of the own vehicle may be grasped based on, for example, a steering angle data of the own vehicle, a navigation data, and an imaging data of front running path.

The lens holder 18 is supported by a base member 20 at the lower end portion thereof. Further, the substrate 16 is supported by a rear portion vertical wall 20*a* of the base member 20.

Next, description will be made on a specific configuration of the projection lens 12.

On a front surface 12*a* of the projection lens 12, a plurality of diffusing lens elements 12*s* that diffuse the light emitted from each light emitting element 14 in the left-right direction is provided in a vertical stripe shape with an equal pitch when viewed from the front side of the lamp. The cross-sectional shape of the plurality of diffusing lens elements 12*s* is set to be corrugated. At this time, in each diffusing lens element 12*s*, a light diffusing angle in the left-right direction is set to a larger value in a center region of the projection lens 12 than in a peripheral region located on both left and right sides of the center region. Specifically, the light diffusing angle in a left-right direction in the vicinity of the vertical plane including the optical axis Ax is set to be the largest, and the light diffusing angle in the left-right direction is set to gradually decrease as the distance from the vertical plane including the optical axis Ax to both the left and right sides increases.

In order to implement this, each diffusing lens element 12*s* is formed so that an uneven shape thereof is gradually moderated as the distance from the vertical plane including the optical axis Ax to the both the left and right sides increases.

Figure 4A:
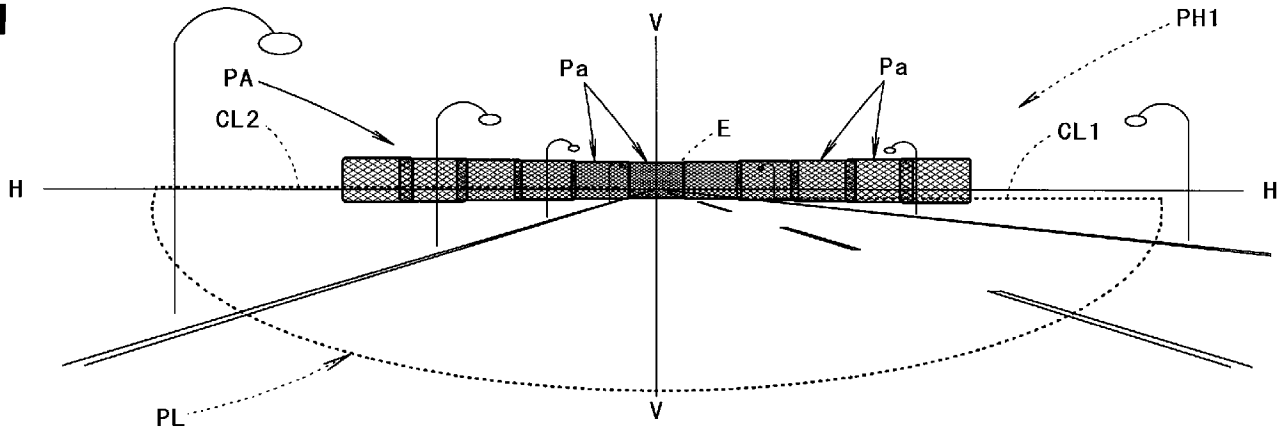
FIGS. 4A and 4B are perspective views illustrating an additional light distribution pattern formed by light irradiated from the vehicle lamp.
Figure 4B:
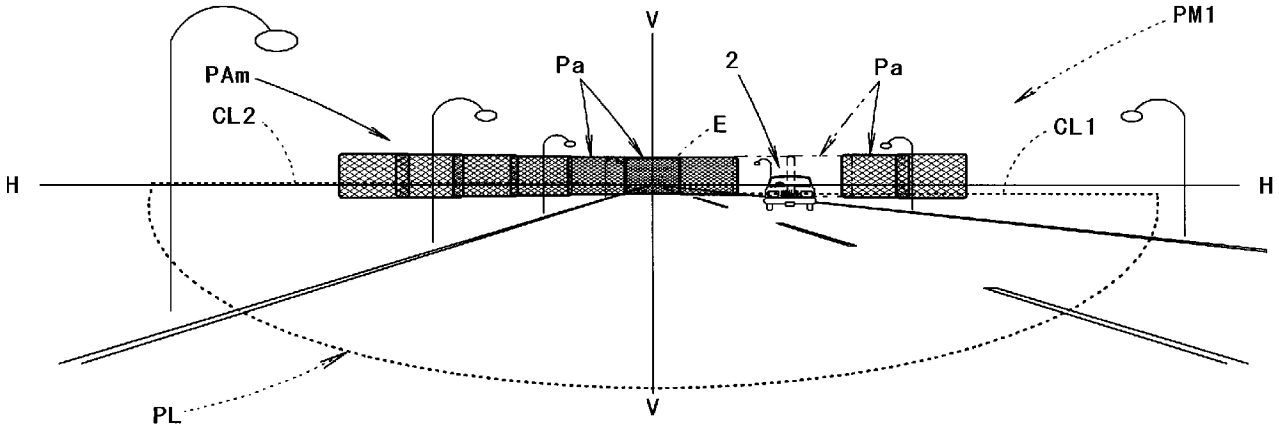

FIGS. 4A and 4B are perspective views illustrating an additional light distribution pattern formed on a virtual vertical screen arranged at a position 25 m away from the front of the vehicle, by the light irradiated toward the front from the vehicle lamp 10. At this time, FIG. 4A is a view illustrating an additional light distribution pattern PA of a high beam light distribution pattern PH1, and FIG. 4B is a view illustrating an additional light distribution pattern PAm of an intermediate light distribution pattern PM1.

The high beam light distribution pattern PH1 illustrated in FIG. 4A is formed by adding the additional light distribution pattern PA formed by the light irradiated from the vehicle lamp 10 to the light distribution pattern Pl formed by the light irradiated from another lamp unit (not illustrated).

The low beam light distribution pattern Pl is a low beam light distribution pattern of left side light distribution, and has cut off lines CL1 and CL2 on the upper end edge thereof which are remarkably different between the left side and the right side. The cut off lines CL1 and CL2 extend in the horizontal direction with a remarkable difference between the left side and the right side at the V-V line as a boundary passing through the H-V which is a vanishing point in vertical direction. A facing lane side portion on the right side of the V-V line is formed as a lower end cut off line CL1, and a own vehicle lane side portion on the left side of the V-V line is formed as an upper end cut off line CL2 which is raised in tier via an inclined portion from the lower end cut off line CL1.

In the low beam light distribution pattern PL, an elbow point E which is an intersection of the lower cut off line CL1 with the V-V line is positioned below the H-V by about 0.5 to 0.6°.

The additional light distribution pattern PA is formed as a horizontally elongated light distribution pattern which is widened upward from the vicinity of the cut off lines CL1 and CL2. At this time, the additional light distribution pattern PA is formed so as to be widened evenly on both left and right sides with respect to the V-V line as a center. Then, the additional light distribution pattern PA is additionally formed with respect to the low beam light distribution pattern PL, so that the high beam light distribution pattern PH1 is formed to widely irradiate the front running path.

The additional light distribution pattern PA is constituted by the eleven light source images Pa.

Each light source image Pa is an image of the light emitting surface 14*a* of each light emitting element 14 which is reversely projected on the virtual vertical screen by the projection lens 12.

At this time, each of the light source images Pa has a substantially rectangular outer shape which is horizontally elongated, and is formed so as to partially overlap with each other. This is due to the fact that the light emitting surface 14*a* of each light emitting element 14 has a square outer shape, and when the light emitting surface 14*a* is reversely projected by the projection lens 12, each light source image Pa is expanded in the left-right direction due to the light diffusing action of the plurality of diffusing lens elements 12*s*.

Further, each light source image Pa is formed so that a position of the lower end edge thereof slightly overlaps the cut off lines CL1 and CL2. This is because the center of the light emitting surface 14*a* of each light emitting elements 14 is positioned slightly below the optical axis Ax, and the upper end edge thereof is positioned slightly above the optical axis Ax.

In the eleven light source images Pa, the light source image Pa positioned at the center is the smallest and the brightest, the light source images Pa adjacent to both left and right sides of the light source image Pa positioned at the center are the second smallest and the second brightest, and the size thereof gradually increases and the brightness thereof gradually decreases toward the light source images Pa positioned at the left and right ends.

The intermediate light distribution pattern PM1 illustrated in FIG. 4B is a light distribution pattern having the additional light distribution pattern PAm in which a part thereof is missing instead of the additional light distribution pattern PA, with respect to the high beam light distribution pattern PH1.

Specifically, the additional light distribution pattern PAm is a light distribution pattern in which the third and the fourth light source images Pa from the right among the eleven light source images Pa are missing. The additional light distribution pattern PAm is formed by turning off the third and the fourth light emitting elements 14 from the left among the eleven light emitting elements 14.

By forming such an additional light distribution pattern PAm, the light irradiated from the vehicle lamp 10 does not illuminate the oncoming vehicle 2. Therefore, the front running path is widely irradiated as far as possible within a range where glare is not given to the driver of the oncoming vehicle 2.

As the position of the oncoming vehicle 2 changes, the shape of the additional light distribution pattern PAm is changed by sequentially switching the light emitting element 14 to be turned off. As a result, the state of irradiating the front running path widely as far as possible is maintained within a range where glare is not given to the driver of the oncoming vehicle 2.

The presence of the oncoming vehicle 2 is detected by, for example, an in-vehicle camera (not illustrated). When a vehicle running ahead on the front running path exists, or a pedestrian exists in a road shoulder portion, glare is not given to the vehicle or the pedestrian by detecting the vehicle or the pedestrian and missing some of the light source images Pa.

Figure 5A:
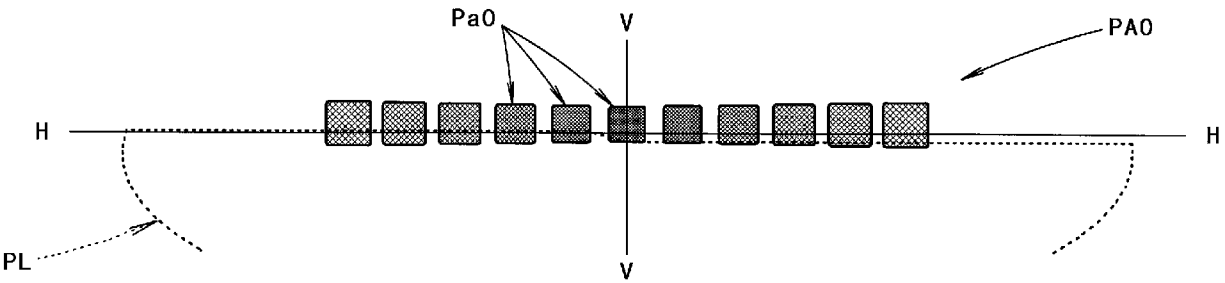
FIGS. 5A to 5C are views for explaining a process of establishing the additional light distribution pattern as compared with an example in the related art.
Figure 5B:
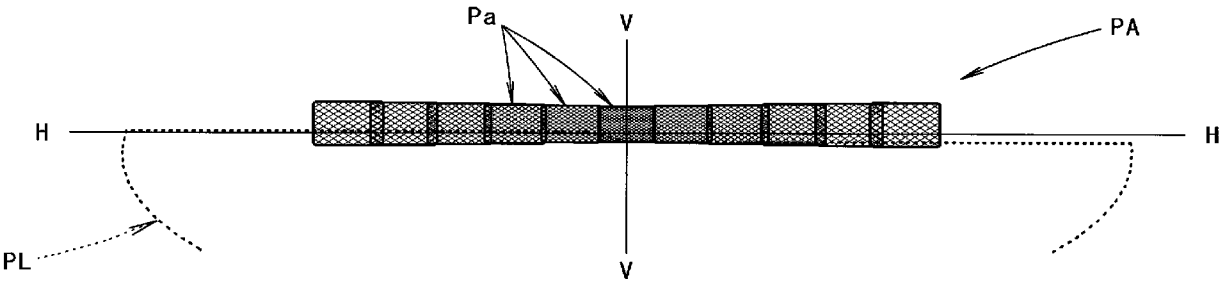
Figure 5C:
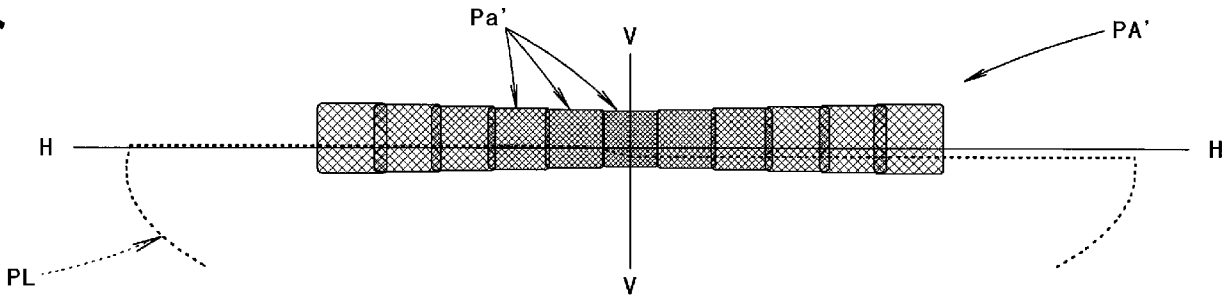

FIGS. 5A to 5C are views for explaining a process of establishing the additional light distribution pattern PA as compared with an example in the related art. Further, FIGS. 6A to 6C are views illustrating illuminance distribution in the horizontal direction of each additional light distribution pattern illustrated in FIGS. 5A to 5C.

An additional light distribution pattern PA0 illustrated in FIG. 5A is a light distribution pattern formed instead of the additional light distribution pattern PA when it is assumed that the plurality of diffusing lens elements 12*s* are not provided on the front surface 12*a* of the projection lens 12.

Figure 6A:
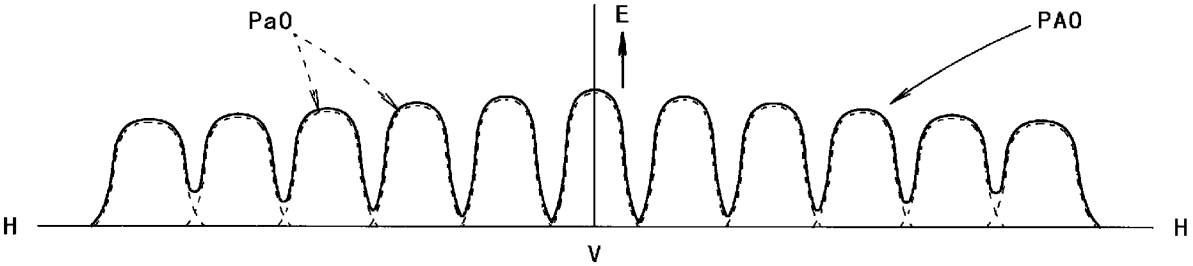
FIGS. 6A to 6C are views illustrating illuminance distribution in the horizontal direction of each additional light distribution pattern illustrated in FIGS. 5A to 5C.
Figure 6B:
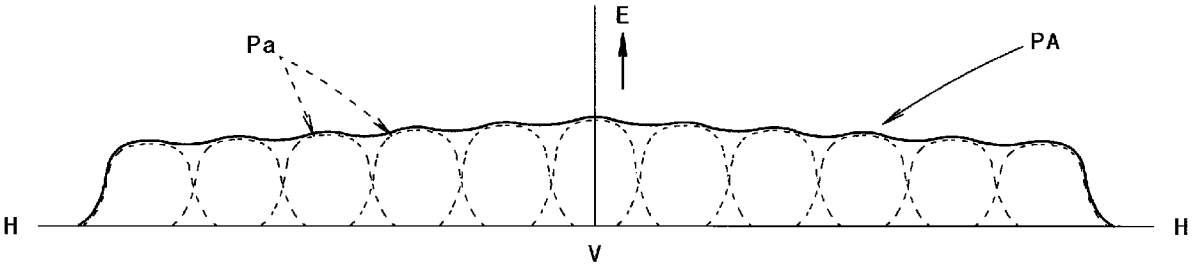
Figure 6C:
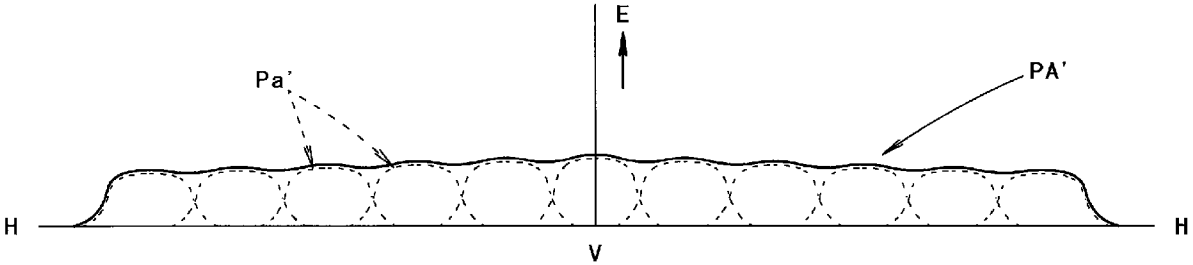

The additional light distribution pattern PA0 has illuminance distribution as illustrated in a solid line in FIG. 6A, and eleven light source images Pa0 that constitute the additional light distribution pattern PA0 has illuminance distribution as illustrated in a broken line in FIG. 6A.

Each light source image Pa0 that constitutes the additional light distribution pattern PA0 is formed by reversely projecting the light emitting surface 14*a* of each light emitting element 14 by the projection lens 12 as it is. Thus, a dark portion is formed between the each of the light source images Pa0.

In the eleven light source images Pa0, the light source image Pa0 positioned at the center is the smallest and the brightest, the light source images Pa0 adjacent to both left and right sides of the light source image Pa0 positioned at the center are the second smallest and the second brightest, and the size thereof gradually increases and the brightness thereof gradually decreases toward the light source images Pa0 positioned at the left and right ends. This is due to the fact that sharpness of the light source image Pa0 is lowered by the distance from the optical axis Ax of the light emitting surface 14*a* of each light emitting element 14.

The additional light distribution pattern PA illustrated in FIG. 5B is a light distribution pattern formed according to the present embodiment.

The additional light distribution pattern PA has illuminance distribution as illustrated in a solid line in FIG. 6B, and the eleven light source images Pa that constitute the additional light distribution pattern PA has illuminance distribution as illustrated in a broken line in FIG. 6B.

Each of the light source images Pa that constitute the additional light distribution pattern PA have a substantially rectangular outer shape which is horizontally elongated, and are formed so as to partially overlap with each other.

As described above, this is due to the fact that each light source image Pa0 illustrated in FIG. 5A is enlarged in the left-right direction by the light diffusing action of the plurality of diffusing lens elements 12*s* provided on the front surface 12*a* of the projection lens 12.

At this time, each light source image Pa is formed by enlarging each light source image Pa0 only in the left-right direction, and thus, the brightness is secured to some extent.

Further, the horizontal cross-sectional shape of the plurality of diffusing lens elements 12*s* provided on the front surface 12*a* of the projection lens 12 are set to be corrugated, and thus, each light source image Pa is a uniformly diffused light source image Pa0.

In addition, in each diffusing lens element 12*s*, a light diffusing angle in the left-right direction is set to a larger value in a center region of the projection lens 12 than in a peripheral region located on both left and right sides of the center region. Thus, each light source image Pa has a smooth illuminance distribution.

Therefore, as illustrated in FIG. 6B, the additional light distribution pattern PA is formed as a light distribution pattern in which the eleven light source images Pa are partially overlap with each other and which has a smooth illuminance distribution.

An additional light distribution pattern PA' illustrated in FIG. 5C is a light distribution pattern formed by displacing each light emitting element 14 to the rear side with respect to a position of the rear side focal point F of the projection lens 12 when it is assumed that the plurality of diffusing lens elements 12*s* are not provided on the front surface 12*a* of the projection lens 12.

The additional light distribution pattern PA' has illuminance distribution as illustrated in a solid line in FIG. 6C, and eleven light source images Pa' that constitute the additional light distribution pattern PA' has illuminance distribution as illustrated in a broken line in FIG. 6C.

Each light source image Pa' that constitutes the additional light distribution pattern PA' is formed as a substantially square image obtained by enlarging each light source image Pa0 that constitutes the additional light distribution pattern PA0 in all direction, as each light emitting element 14 is displaced to the rear side with respect to the rear side focal point F of the projection lens 12.

Therefore, as illustrated in FIG. 6C, the additional light distribution pattern PA' is formed as a light distribution pattern in which the eleven light source images Pa partially overlap with each other and which has a smooth illuminance distribution. However, since each light source image Pa0 is enlarged not only in the left-right direction, but also in the vertical direction, the overall brightness is reduced.

Next, the operational effects of the present embodiment will be described.

The vehicle lamp 10 according to the present disclosure has a configuration in which eleven light emitting elements 14 are arranged in parallel in the left-right direction (the required direction) behind the projection lens 12, and the light emitted from each light emitting element 14 is irradiated toward the front through the projection lens 12. Thus, when simultaneously turning on the eleven light emitting elements 14, it is possible to form the additional light distribution pattern PA extending in the horizontal direction (the required direction) as an aggregate of the light source images Pa of the respective light emitting elements.

In addition, on the front surface 12*a* of the projection lens 12, the plurality of diffusing lens elements 12*s* which diffuse the light emitted from each light emitting element 14 in the left-right direction are provided in a vertical stripe shape (a stripe shape to extend in a direction orthogonal to the required direction) when viewed from the front of the lamp. Thus, each of the light source images Pa may be formed partially overlapping each other.

At this time, the light source images Pa of the respective light emitting elements 14 are enlarged in the left-right direction by the plurality of diffusing lens elements 12*s*, but are not enlarged in all directions. Thus, it is possible to secure brightness of the horizontally elongated additional light distribution pattern PA.

As described above, according to the present disclosure, in the vehicle lamp 10 configured to irradiate the light emitted from the eleven light emitting elements 14 toward the front through the projection lens 12, the additional light distribution pattern PA formed by the irradiated light may be formed as a continuous bright light distribution pattern.

At this time, in the present embodiment, the plurality of diffusing lens elements 12*s* are provided on the front surface 12*a* of the projection lens 12, and thus, it is possible to control the diffusion of the light emitted from each light emitting element 14 that has reached the projection lens 12, when emitting from the projection lens 12. Therefore, the accuracy of the light diffusing angle in the left-right direction may be enhanced. Therefore, it is possible to more easily form the horizontally elongated additional light distribution pattern PA as a light distribution pattern with less light non-uniformity.

In addition, in the present embodiment, as a configuration of each diffusing lens element 12*s*, a light diffusing angle in the left-right direction is set to a larger value in the center region of the projection lens 12 than in the peripheral region located on both left and right sides of the center region. Thus, the following operational effects may be obtained.

That is, when it is assumed that the plurality of diffusing lens elements 12*s* are not provided on the front surface 12*a* of the projection lens 12, as illustrated in FIG. 5A, the light source image Pa0 has different brightness or size depending on a position of the light emitting element 14. Specifically, the light source image Pa0 of the light emitting element 14 positioned in the vicinity of the optical axis Ax of the projection lens 12 is small and bright, while the light source image Pa0 of the light emitting element 14 at a position away from the optical axis Ax is large and dark.

Therefore, as illustrated in FIG. 6A, the horizontally elongated additional light distribution pattern PA0 becomes brighter at a portion positioned in a front direction of the lamp, but the dark portion formed between the light source images Pa0 becomes noticeable. Meanwhile, in the portion apart from the left-right direction in the front direction of the lamp, the dark portion between the light source images Pa0 is not noticeable, but the light source image Pa0 itself becomes dark.

In this regard, as a configuration of each diffusing lens element 12*s*, by having a configuration in which a light diffusing angle in the left-right direction is set to a larger value in the center region of the projection lens 12 than in the peripheral region, it is possible to effectively suppress occurrence of light non-uniformity in the light source images Pa of the respective light emitting elements 14 enlarged in the left-right direction. Therefore, the additional light distribution pattern PA as an aggregate of the eleven light source images Pa may be formed as a light distribution pattern with less light non-uniformity.

Moreover, in the peripheral region where the light diffusing angle of each diffusing lens element 12*s* is set to a small value, the unevenness of the surface may be reduced, so that the projection lens 12 may be easily formed.

Further, in the present embodiment, the cross-sectional shape of the plurality of diffusing lens elements 12*s* is set to be corrugated, and thus it is possible to form the eleven light source images Pa so as to be smoothly continued in the horizontal direction. Therefore, the light non-uniformity of the additional light distribution pattern PA may be effectively suppressed.

In the above embodiment, description has been made on the case where the horizontal cross-sectional shape of the plurality of diffusing lens elements 12*s* is set to be corrugated, but it is possible to be configured to have other horizontal cross-sectional shapes (e.g., a convexly curved or a concavely curved horizontal cross-sectional shape).

In the above embodiment, description has been made on the case where the light emitting surface 14*a* of each light emitting element 14 has a square outer shape, but it is possible to be configured to have other outer shapes (e.g., a vertically elongated rectangular or a horizontally elongated rectangular outer shape).

In the above embodiment, description has been made on the case where eleven light emitting elements 14 are provided, but it is possible to be configured to be provided with other number of light emitting elements.

In the above embodiment, description has been made on the case where the projection lens 12 has a circular outer shape when viewed from the front of the lamp, but it is possible to be configured to have other outer shapes (e.g., a shape obtained by cutting off a part of a circle, a rectangle, a trapezoid, a polygonal shape).

Next, a modification of the above embodiment will be described.

First, a first modification of the above embodiment will be described.

Figure 7:
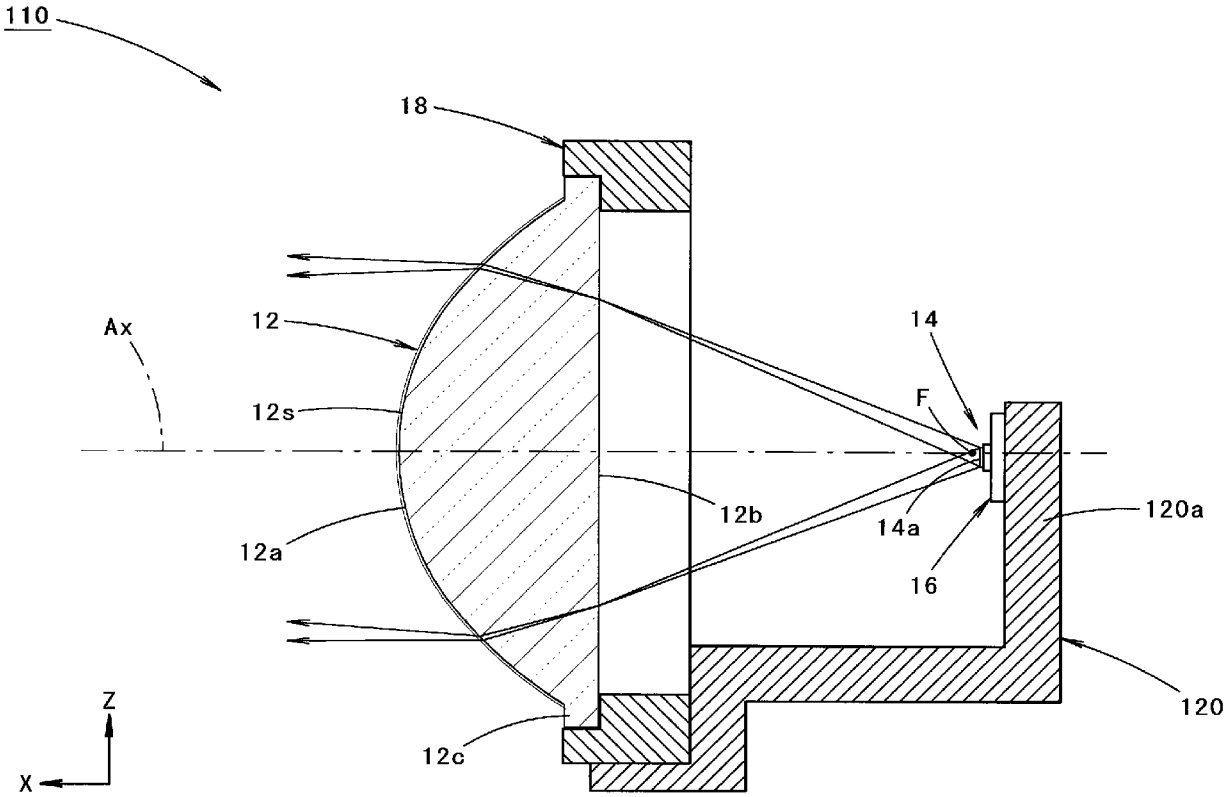
FIG. 7 is a view illustrating a first modification of the embodiment, which is similar to FIG. 2.

FIG. 7 is a view illustrating a vehicle lamp 110 according to the present modification, which is similar to FIG. 2.

As illustrated in the drawing, the basic configuration of the vehicle lamp 110 is the same as the vehicle lamp 10 of the above embodiment, but the arrangement of the eleven light emitting elements 14 is different from the above embodiment. Thus, a configuration of a base member 120 is partially different from the above embodiment.

That is, in the present modification, the eleven light emitting elements 14 are arranged at a position displaced to the rear side from the rear side focal point plane including the rear side focal point F of the projection lens 12. In order to implement this, a rear vertical wall 120*a* of the base member 120 is displaced further to the rear side compared with the case of the above embodiment.

Figure 8A:
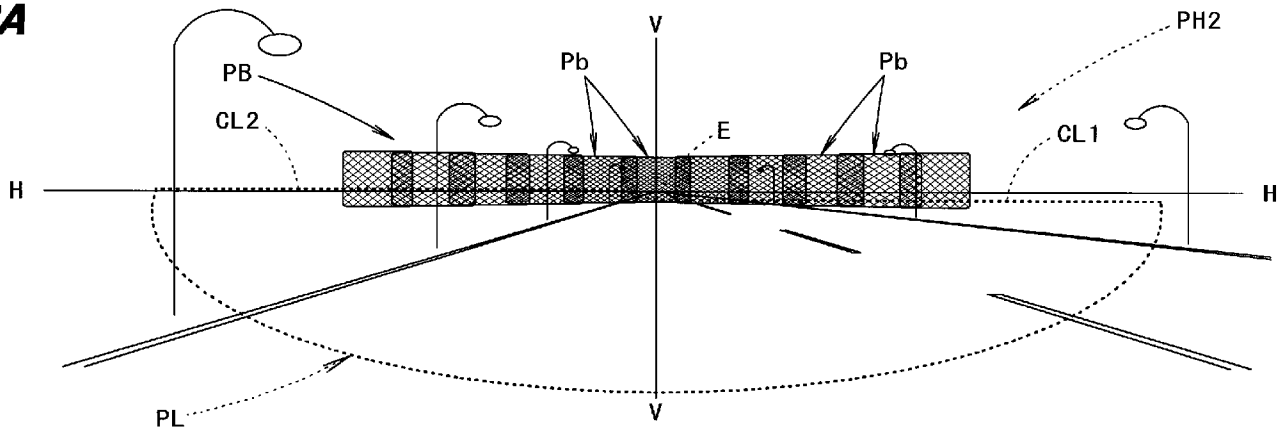
FIGS. 8A and 8B are views illustrating an operation of the first modification of the embodiment, which are similar to FIGS. 4A and 4B.
Figure 8B:
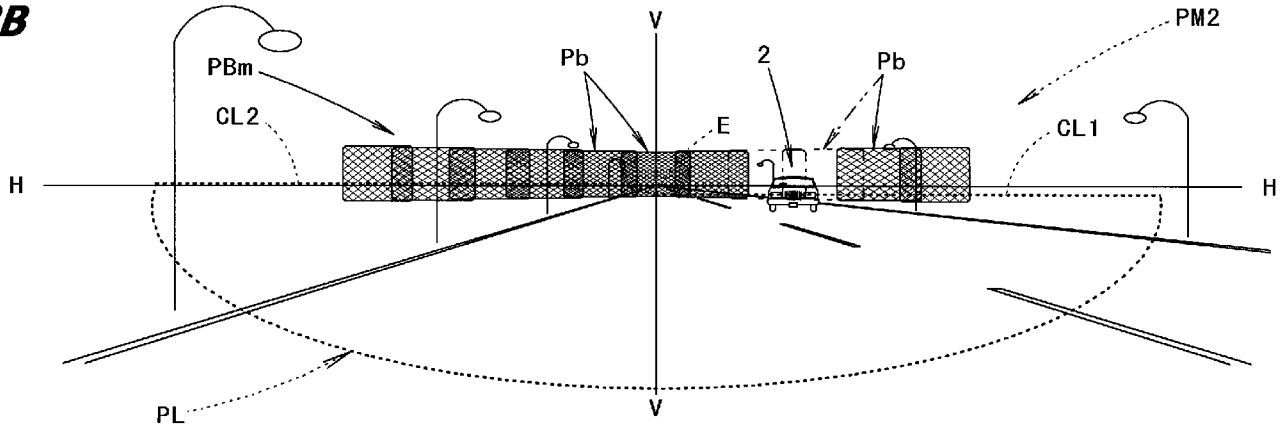

FIGS. 8A and 8B are views perspectively illustrating an additional light distribution pattern formed by light irradiated from the vehicle lamp 110. At this time, FIG. 8A is a view illustrating an additional light distribution pattern PB of a high beam light distribution pattern PH2, and FIG. 8B is a view illustrating an additional light distribution pattern PBm of an intermediate light distribution pattern PM2.

Each light source image Pb that constitutes the additional light distribution pattern PB is an image which is slightly darker than each light source image Pa that constitutes the additional light distribution pattern PA of the above embodiment, but is horizontally elongated image which is much larger than each light source image Pa.

The additional light distribution pattern PB is a light distribution pattern in which each of the light source images Pb partially overlaps each other, but the proportion of the overlapped portion is larger than the additional light distribution pattern PA of the above embodiment.

As described above, in the present modification, the eleven light emitting elements 14 are arranged at the position displaced to the rear side from the rear side focal point F of the projection lens 12, and thus, it is possible to enlarge the light source images Pb of each of the light emitting elements 14 so as to partially overlap with each other. Therefore, the light non-uniformity of the additional light distribution pattern PB may be much more effectively suppressed.

In the above first modification, it is described that each light emitting element 14 is arranged on the rear side of the rear side focal point F of the projection lens, but it is possible to have a configuration in which the light emitting element 14 is arranged on the front side of the rear side focal point F.

Next, a second modification of the above embodiment will be described.

Figure 9:
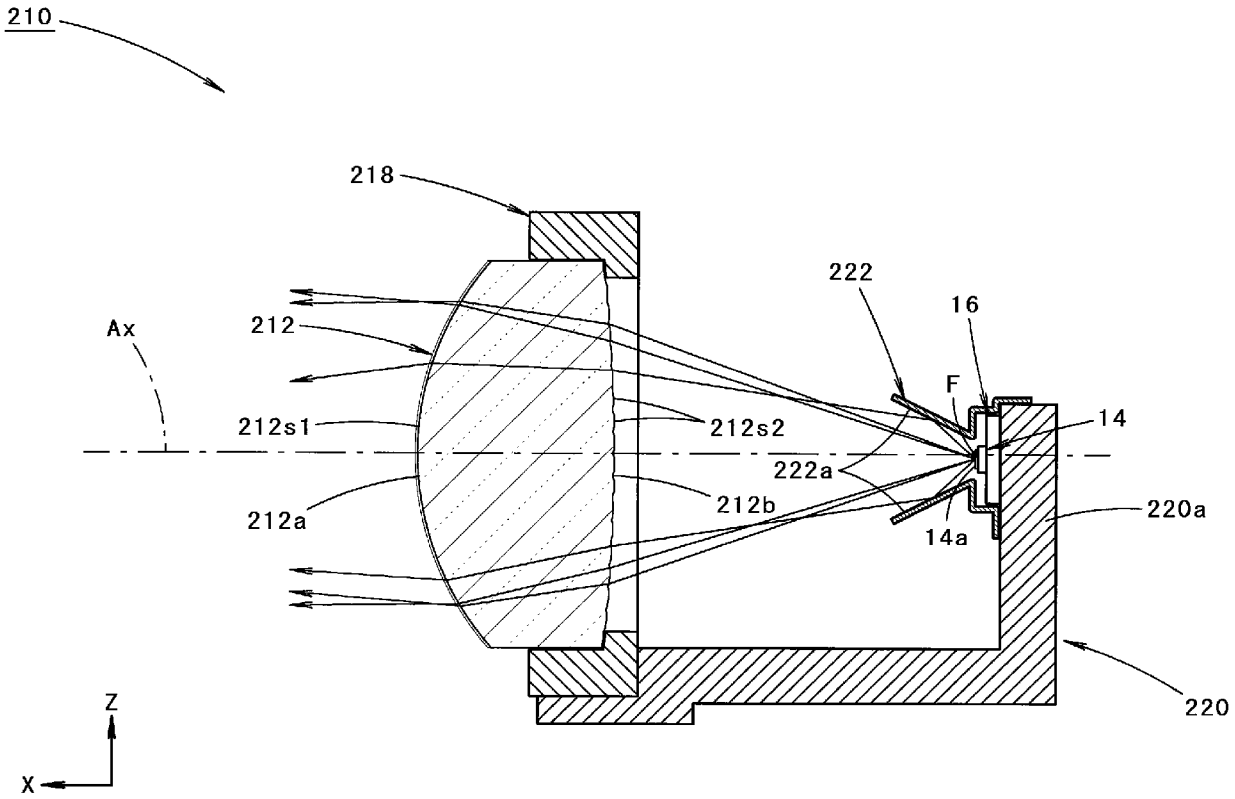
FIG. 9 is a view illustrating a second modification of the embodiment, which is similar to FIG. 2.

FIG. 9 is a view illustrating a vehicle lamp 210 according to the present modification, which is similar to FIG. 2.

As illustrated in the drawing, the basic configuration of the vehicle lamp 210 is the same as the vehicle lamp 10 of the above embodiment, but the configuration of the projection lens 212 is different from the above embodiment. Thus, configurations of a lens holder 218 and a base member 220 are also partially different from the above embodiment. Moreover, in the modification, a reflector 222 is additionally arranged around the eleven light emitting elements 14.

The projection lens 212 of the present modification has a shape that an upper end portion and a lower end portion of the projection lens 12 of the above embodiment are cut off. Further, the projection lens 212 is configured as a biconvex lens, and at this time, the front surface 212*a* is configured by a convex curved surface having a larger curvature than the rear surface 212*b*.

A front surface 212*a* of the projection lens 212 has a configuration in which a plurality of diffusing lens elements 212*s*1 are provided in a vertical stripe shape on like the case of the projection lens 12 of the above embodiment. In addition, on a rear surface 212*b* of the projection lens 212, a plurality of second diffusing lens elements 212*s*2 for diffusing the light emitted from each light emitting element 14 in the vertical direction is provided in a horizontal stripe shape having equal pitch when viewed from the front of the lamp. At this time, each second diffusing lens element 212*s*2 has a configuration having a convex curved vertical cross-sectional shape.

The reflector 222 has a pair of upper and lower reflecting surfaces 222*a* extending in a planar shape from the vicinity of the upper end edge and the lower end edge of the light emitting surface 14*a* of the eleven light emitting elements 14 toward obliquely upper-front and obliquely lower-front. At this time, each reflecting surface 222*a* is formed so as to extend horizontally to the vicinity of both left and right end edges of the substrate 16 while maintaining the vertical cross-sectional shape.

The reflector 222 is configured to specularly reflect the light emitted from each light emitting element 14 toward obliquely upper-front and obliquely lower-front on the pair of upper and lower reflecting surfaces 222*a* so as to be incident on the projection lens 212. The reflector 222 is supported by a rear portion vertical wall 220*a* of the base member 220.

Figure 10:
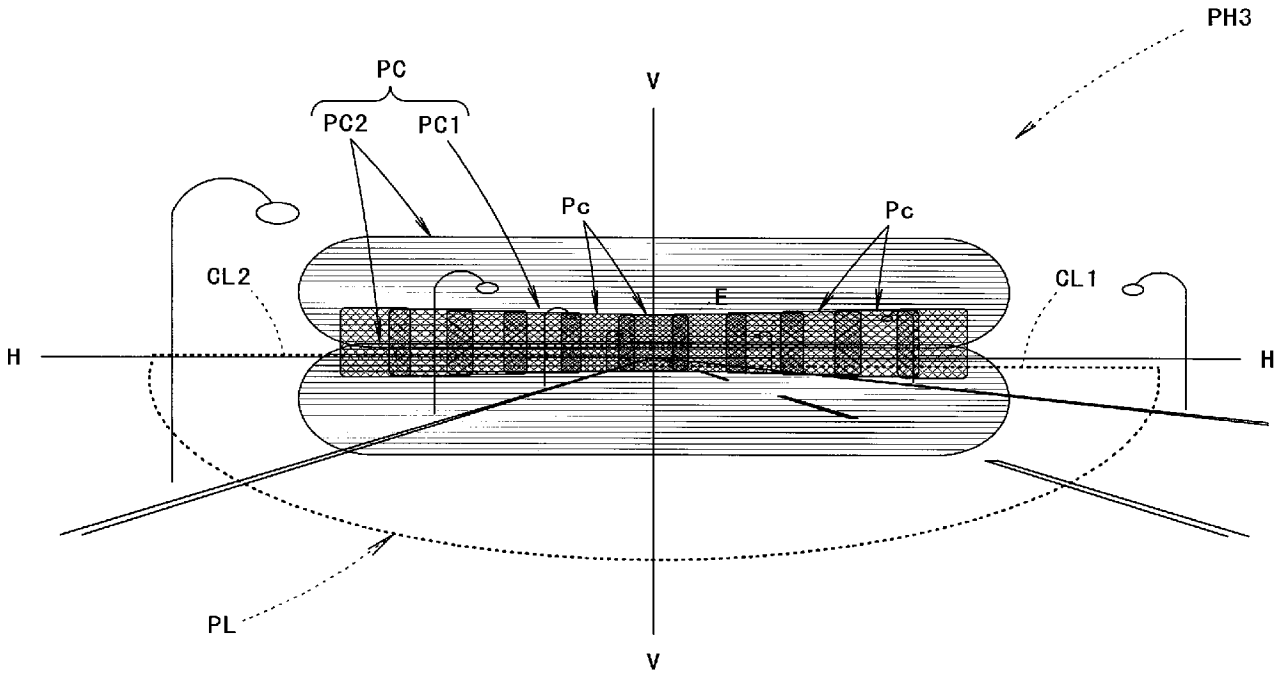
FIG. 10 is a view illustrating an operation of the second modification of the embodiment, which is similar to FIGS. 4A and 4B.

FIG. 10 is a view perspectively illustrating an additional light distribution pattern PC of a high beam light distribution pattern PH3 formed by light irradiated from the vehicle lamp 210.

The additional light distribution pattern PC is formed as a light distribution pattern formed by synthesizing a light distribution pattern PC1 constituted by eleven light source images Pc formed by direct light from the eleven light emitting elements 14 and a pair of upper and lower light distribution patterns PC2 formed by a reflecting light from a pair of upper and lower reflecting surfaces 222*a*.

Each light source image Pc that constitutes the light distribution pattern PC1 is formed with a vertical width larger than that of each light source image Pa that constitutes the additional light distribution pattern PA of the above embodiment. This is due to the fact that the plurality of second diffusing lens elements 212*s*2 are provided on the rear surface 212*b* of the projection lens 212.

Both of the pair of upper and lower light distribution patterns PC2 are horizontally elongated light distribution patterns, and formed so as to partially overlap with the light distribution pattern PC1.

In a case where the configuration of the present modification is adopted, substantially the same operational effects as the above embodiment may be obtained.

Further, by adopting the configuration of the present modification, it is possible to secure the brightness of the main portion after forming the additional light distribution pattern PC as a light distribution pattern having a large vertical width.

Next, a third modification of the above embodiment will be described.

Figure 11:
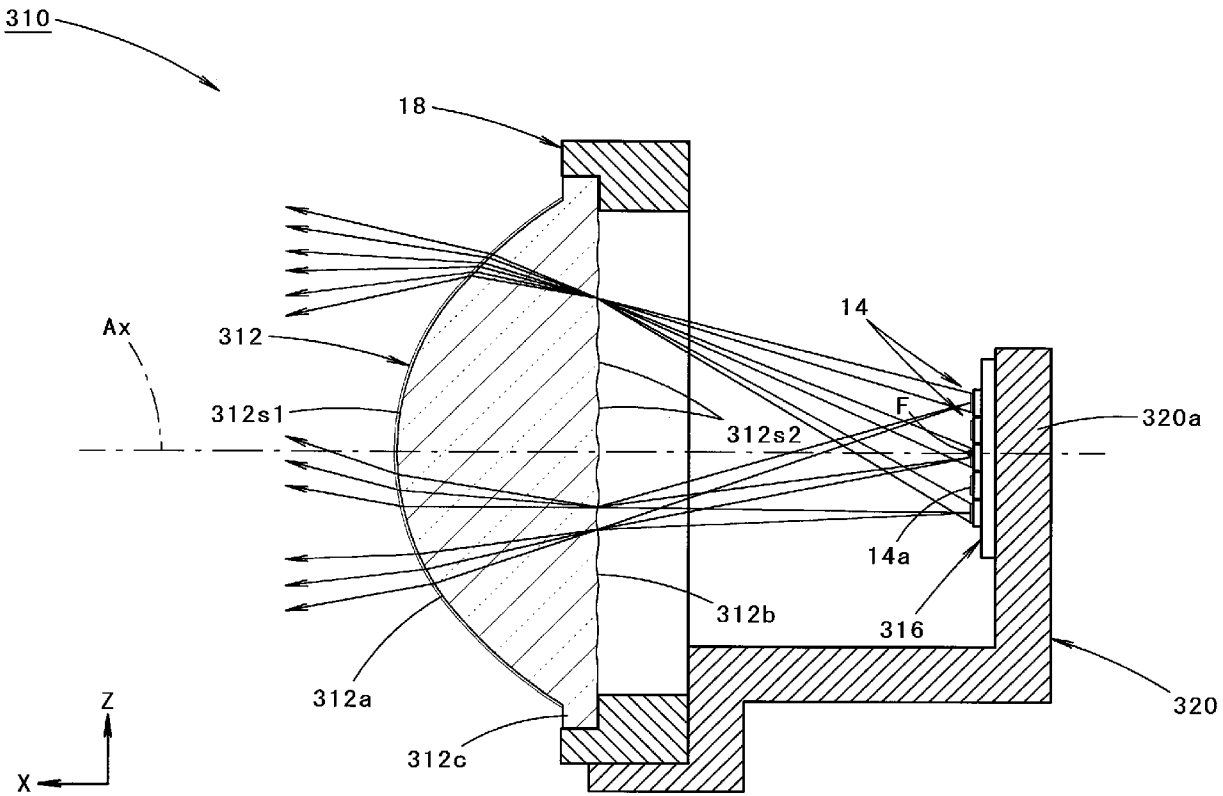
FIG. 11 is a view illustrating a third modification of the embodiment, which is similar to FIG. 2.

FIG. 11 is a view illustrating a vehicle lamp 310 according to the present modification, which is similar to FIG. 2.

As illustrated in the drawing, the basic configuration of the vehicle lamp 310 is the same as the vehicle lamp 10 of the above embodiment, but the configuration of the projection lens 312 is different from the above embodiment. Further, the eleven light emitting elements 14 are arranged in vertical five tiers. Therefore, a configuration of a base member 320 is partially different from the case of the above embodiment.

A front surface 312*a* of the projection lens 312 of the present modification is also provided with a plurality of diffusing lens elements 312*s*1 in a vertical stripe shape like the case of the projection lens 12 of the above embodiment, and is supported by the lens holder 18 at an outer peripheral flange portion 312*c*.

However, the projection lens 312 of the present modification is different from the projection lens 12 of the above embodiment in that a plurality of second diffusing lens elements 312*s*2 configured to diffuse the light emitted from each light emitting element 14 in the vertical direction are provided on a rear surface 312*b* of the projection lens 312.

The plurality of second diffusing lens elements 312*s*2 are provided in a horizontal stripe shape having equal pitch when viewed from the front of the lamp, and a vertical cross-sectional shape thereof is set to be corrugated. At this time, in each second diffusing lens element 312*s*2, a light diffusing angle in the vertical direction is set to a larger value in a center region of the projection lens 312 than in a peripheral region located on both upper and lower sides of the center region. Specifically, the light diffusing angle in the vertical direction in the vicinity of the horizontal plane including the optical axis Ax is set to be the largest, and the light diffusing angle in the vertical direction is set to gradually decrease as the distance from the horizontal plane including the optical axis Ax to both the upper and lower sides increases. In order to implement this, each second diffusing lens element 312*s*2 is formed so that an uneven shape thereof is gradually moderated as the distance from the horizontal plane including the optical axis Ax to the both the upper and lower sides increases.

The eleven light emitting elements 14 arranged in vertical five tiers have a configuration in which 2 tiers of eleven light emitting elements 14 are additionally arranged respectively at upper side and lower side of the eleven light emitting elements 14 arranged at the same position as in the above embodiment. At this time, the 5*11 light emitting elements 14 are supported by the substrate in a state of being arranged at equal intervals in both of the vertical and horizontal directions. The substrate 316 is supported by a rear portion vertical wall 320*a* of the base member 320.

Figure 12:
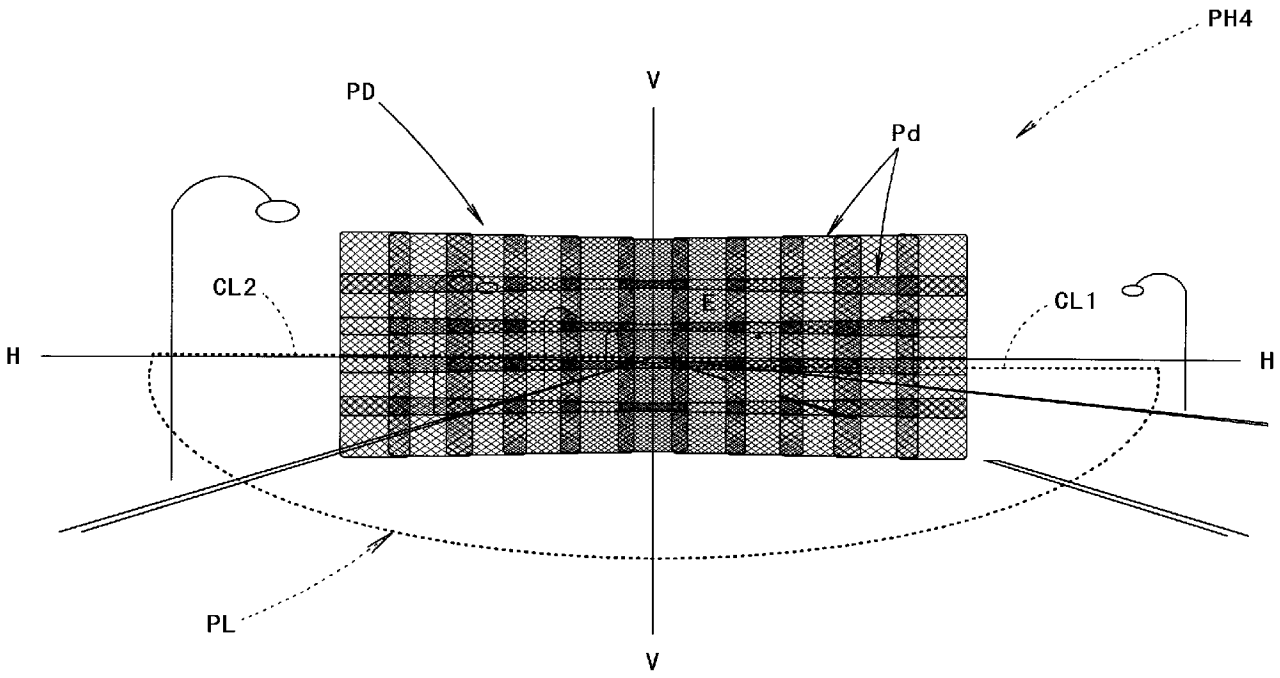
FIG. 12 is a view illustrating an operation of the third modification of the embodiment, which is similar to FIGS. 4A and 4B.

FIG. 12 is a view perspectively illustrating an additional light distribution pattern PD of a high beam light distribution pattern PH4 formed by light irradiated from the vehicle lamp 310.

The light source images Pd of the 5*11 light source images Pa constitute the additional light distribution pattern PD. Each of the light source images Pd are images of the light emitting surface 14*a* of the respective light emitting elements 14 reversely projected on the virtual vertical screen by the projection lens 312, have a substantially rectangular outer shape which is horizontally elongated, and are formed so as to partially overlap with each other in the vertical direction and the left-right direction.

Each light source image Pd positioned in the middle tier is formed with a vertical width larger than that of each light source image Pa that constitutes the additional light distribution pattern PA of the above embodiment. This is due to the fact that the plurality of second diffusing lens elements 312*s*2 are provided on the rear surface 312*b* of the projection lens 312.

Each light source image Pd positioned in the second tier and the fourth tier from the top is formed with a vertical width slightly larger than each light source image Pd positioned in the middle tier. Further, each light source image Pd positioned in the uppermost tier and the lowermost tier is formed with a vertical width slightly larger than each light source image Pd positioned in the second tier and the fourth tier from the top.

In a case where the configuration of the present modification is adopted, substantially the same operational effects as the above embodiment may be obtained.

Further, by adopting the configuration of the present modification, the additional light distribution pattern PD may be formed as a light distribution pattern having a large vertical width and a bright brightness.

In addition, in the present modification, a light diffusing angle of each second diffusing lens element 312*s*2 in the vertical direction is set to a larger value in the center region of the projection lens 312 than in the peripheral region located on both upper and lower sides of the center region. Thus, the following operational effects may be obtained.

That is, as in the present modification, even in the case where the eleven light emitting elements 312*s*2 arranged in parallel in the left-right direction are arranged over vertical five tiers, occurrence of light unevenness in the light source images Pd of the respective light emitting elements 14 enlarged in the vertical direction may be effectively suppressed. Therefore, even in the case where the additional light distribution pattern PD having a two-dimensional area formed by expanding the horizontally elongated light distribution pattern PA of the above embodiment in the vertical direction is formed, the light non-uniformity may be effectively suppressed.

It is possible to use the additional light distribution pattern PD formed according to the present modification as a high beam light distribution pattern itself, not as a light distribution pattern additionally formed with respect to the low beam light distribution pattern PL in the high beam light distribution pattern PH4.

Further, numeric values shown as specifications in the above embodiments and the modifications thereof are merely illustrative, and different values may be, of course, set as appropriate.

From the foregoing, it will be appreciated that various embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A vehicle lamp comprising:

a projection lens;

a plurality of light emitting elements arranged in parallel in a required direction behind the projection lens, and configured to irradiate light emitted from each of the light emitting elements toward a front side through the projection lens; and a plurality of diffusing lenses that diffuse the light emitted from each of the light emitting elements in the required direction, wherein the plurality of diffusing lenses are provided on a front surface and/or a rear surface of the projection lens in a stripe shape to extend in a direction orthogonal to the required direction when viewed from a front side of the lamp, and in each of the plurality of diffusing lenses, a light diffusing angle in the required direction is set to a larger value in a center region of the projection lens than in a peripheral region located on both sides of the required direction of the center region.

2. The vehicle lamp of claim 1, wherein a cross-sectional shape of the plurality of diffusing lenses along the required direction is set to be corrugated.

3. The vehicle lamp of claim 2, wherein the plurality of light emitting elements are arranged at a position displaced in a front-rear direction from a rear side focal point of the projection lens.

4. The vehicle lamp of claim 1, wherein the plurality of light emitting elements are arranged at a position displaced in a front-rear direction from a rear side focal point of the projection lens.

5. The vehicle lamp of claim 1, wherein the required direction is set to a left-right direction, and the plurality of diffusing lenses are provided in a vertical stripe shape on the front surface of the projection lens.

6. The vehicle lamp of claim 5, further comprising:

a plurality of second diffusing lenses that diffuse the light emitted from each of the light emitting elements in a vertical direction, wherein the plurality of second diffusing lenses are provided on the rear surface of the projection lens in a horizontal stripe shape.

7. The vehicle lamp of claim 6, wherein, in each of the plurality of second diffusing lenses, a light diffusing angle in the vertical direction is set to a larger value in a center region of the projection lens than in a peripheral region located on both sides of the vertical direction of the center region.

8. The vehicle lamp of claim 6, wherein the plurality of second diffusing lenses have a convex curved vertical cross-sectional shape.

9. The vehicle lamp of claim 1, further comprising:

a reflector that has a pair of upper and lower reflecting surfaces extending in a planar shape from a vicinity of an upper end edge and a lower end edge of a light emitting surface of the plurality of light emitting elements toward an obliquely upper-front and an obliquely lower-front.

10. The vehicle lamp of claim 9, wherein each of the pair of upper and lower reflecting surfaces is formed so as to extend horizontally to a vicinity of both left and right end edges of a substrate that supports the plurality of light emitting elements while maintaining a vertical cross-sectional shape.

11. The vehicle lamp of claim 1, wherein the plurality of light emitting elements are arranged in a plurality of vertical stages.

* * * * *